US006680710B1

(12) United States Patent
Merenda

(10) Patent No.: US 6,680,710 B1
(45) Date of Patent: Jan. 20, 2004

(54) CROSSED-LOOP RADIATION SYNTHESIZER SYSTEMS

(75) Inventor: Joseph T. Merenda, Northport, NY (US)

(73) Assignee: BAE Systems Information and Electronic Systems Integration Inc., Greenlawn, NY (US)

( * ) Notice: Subject to any disclaimer, the term of this patent is extended or adjusted under 35 U.S.C. 154(b) by 0 days.

(21) Appl. No.: 10/114,101

(22) Filed: Apr. 2, 2002

(51) Int. Cl.[7] ..... H01Q 11/12

(52) U.S. Cl. ..... 343/742; 343/701; 343/867; 343/876

(58) Field of Search ..... 343/701, 741, 343/742, 744, 866, 867, 876; 333/103; H01Q 11/12, 11/14

(56) References Cited

U.S. PATENT DOCUMENTS 3,683,389 A * 8/1972 Hollis ..... 343/788
4,760,394 A * 7/1988 Takeuchi et al. ..... 340/10.42
5,351,688 A * 10/1994 Jones ..... 600/422
5,402,133 A 3/1995 Merenda ..... 343/701
5,784,032 A * 7/1998 Johnston et al. ..... 343/702
5,805,114 A * 9/1998 Podger ..... 343/742
6,150,986 A * 11/2000 Sandberg et al. ..... 343/742
6,229,494 B1 5/2001 Merenda ..... 343/741

* cited by examiner

*Primary Examiner*—Tho Phan
(74) *Attorney, Agent, or Firm*—Edward A. Onders; Kenneth P. Robinson

(57) ABSTRACT

Radiation synthesizer systems provide efficient wideband operation with loop antenna elements which are small relative to operating wavelength. Energy dissipation is substantially reduced by cycling energy back and forth between a high-Q radiator and a storage capacitance under control of a switching circuit. Systems using multi-segment loop antennas match input impedance to switching circuit parameters. Use of such antennas in crossed-loop configurations excited in quadrature and supported on a wearable garment provide body-borne antennas with isotropic type coverage. With light-weight flexible construction, a wearable radiating system can avoid any need for visually identifiable features and provide effective antenna pattern coverage regardless of the wearer's body orientation, whether standing, prone or otherwise.

20 Claims, 7 Drawing Sheets

CROSSED-LOOP RADIATION SYNTHESIZER SYSTEMS

RELATED APPLICATIONS (Not Applicable)

FEDERALLY SPONSORED RESEARCH (Not Applicable)

BACKGROUND OF THE INVENTION

The present invention relates to radiating systems and, more particularly, to improved radiation synthesizer systems enabling efficient use of small high-Q antennas by active control of energy transfer back and forth between an antenna reactance and a storage reactance.

The theory and implementation of Synthesizer Radiating Systems and Methods are described in U.S. Pat. No. 5,402,133 of that title as issued to the present inventor on Mar. 28, 1995. Further aspects are described in U.S. Pat. No. 6,229,494, titled Radiation Synthesizer Systems and Methods, as issued to the present inventor on May 8, 2001. These patents ("the '133 patent" and "the '494 patent") are hereby incorporated by reference.

A basic radiation synthesizer circuit, as described in the '133 patent, which combines transfer circuits in both directions using two switches is shown in FIG. 1*a*. This circuit functions as an active loop antenna where the loop antenna L is the high Q inductive load and a capacitor C is used as the storage reactor. The FIG. 1*a* circuit uses two RF type switching transistors, shown as switches RC and DC, for rate and direction control, respectively. Because the devices are operated in a switch mode, efficient operation is obtained since, in theory, no instantaneous power is ever dissipated by such devices. A slower switching device, shown as power control switch PC, can be used to add energy to the circuit from the power supply as energy is radiated. The voltage and current sensor terminals VS and CS, respectively, are used to monitor and calculate the total amount of stored energy at any instant in time, while a feedback control circuit is used to maintain the total energy at a preset value through use of the power control switch PC.

In the FIG. 1*a* circuit, when the direction control switch is open, energy can be transferred from current through the inductor L to voltage across the capacitor C, as illustrated by the L to C energy transfer diagram of FIG. 1*b*. With the rate control switch closed, current flows from ground, through diode D1 and L, and back to ground through the rate control switch RC. In the absence of circuit losses, the current would continue to flow indefinitely. When the rate control switch RC is opened, the inductor current, which must remain continuous, flows through diode D2 and charges up the capacitor C. The rate at which C charges up is determined by the switch open duty cycle of the switch RC. The capacitor will charge up at the maximum rate when the switch is continuously open. The charging time constant is directly proportional to the switch open duty cycle of the rate control switch RC.

When the direction control switch DC of FIG. 1*a* is closed, energy can be transferred from voltage across the capacitor to current through the inductor, as shown in the C to L energy transfer diagram of FIG. 1*c*. Diode D1 is always back biased and is, therefore, out of the circuit. When the rate control switch RC is closed, the capacitor C will discharge through L, gradually building up the current through L. If the rate control switch is opened, the capacitor will maintain its voltage while the inductor current flows in a loop through diode D2. In this C to L direction transfer mode, the rate is controlled by the switch closure duty cycle of switch RC. The maximum rate of energy transfer occurs when the switch RC is continuously closed. Its operation is the inverse of that in the other direction transfer mode (L to C).

It should be noted that, in either direction, charge or discharge is exponential. Therefore, the rate of voltage or current rise is not constant for a given rate control duty cycle. In order to maintain a constant rate of charging (ramp in voltage or current), it is necessary to appropriately modulate the duty cycle as charging progresses. Duty cycle determinations and other aspects of operation and control of radiation synthesizer systems are discussed at length in the '133 patent (in which FIGS. 1*a*, 1*b* and 1*c* referred to above appear as FIGS. 8*a*, 8*b* and 8*c*).

In theory, since the power which is not radiated is transferred back and forth rather than being dissipated, lossless operation is possible. However, as recognized in the '133 patent losses are relevant in high frequency switching operations, particularly as a result of the practical presence of ON resistance of switch devices and inherent capacitance associated with switch control terminals. While such device properties are associated with very small losses of stored energy each time a switch is closed, aggregate losses can become significant as high switching frequencies are employed. In addition, if small loop antennas are to be employed, for example, antenna impedance may be higher than basic switching circuit impedance levels, necessitating use of impedance matching circuits which may have less than optimum operating characteristics.

The basic radiation synthesizer circuit discussed above can be reduced to the simplified ideal model shown in FIG. 2. This model replaces the diodes in the basic circuit by ideal switches, and provides push-pull operation (current can flow in either direction through the loop antenna). The push-pull, or bipolar circuit, is more efficient than the single-ended circuit by a factor of 2 (3 dB). The FIG. 2 system includes four power switch devices comprising a switching circuit pursuant to the invention, a complete implementation of which is provided in the '494 patent (see FIG. 12). The FIG. 2 system includes loop antenna 12, storage capacitor 14 and power switch devices 21, 22, 23 and 24, which will also be referred to as switch devices S1, S2, S3 and S4, respectively. Three possible states exist: linear charging of inductor current, linear discharging, and constant current. It is possible to synthesize any waveform using this circuit, with waveform fidelity dependent on sampling speed.

FIG. 2 shows a basic form of synthesizer radiating system. It uses a single switching circuit that is connected to the two input terminals of a standard loop antenna. Each switch may consist of several individual devices either connected in series or parallel in order to realize optimized performance at the desired radiation power level. At some frequencies of operation additional practical constraints may require consideration. As a first consideration, the device parameters may necessitate very low antenna input terminal impedance in order to realize acceptable performance. That impedance may not be compatible with a single-turn loop of appropriate size. As a second consideration, a single-turn loop may be subject to an electrical resonance when the antenna is moderately small. This resonance occurs when the distance around the loop perimeter approaches one-half wavelength at an operating frequency.

Pursuant to the '494 patent, a multi-segment loop configuration using distributed switching electronics provides a solution addressing these considerations. An embodiment in which the antenna has been broken into four loop segments and uses four switching circuits controlled by synchronous signals is described by way of example in this patent. The effective terminal impedance that is presented to each sub-circuit is equal to 1/N times the total loop impedance where N is the number of loop segments. Hence, the optimum low-impedance antenna impedance level may be achieved by dividing the loop into the appropriate number of segments. The electrical resonance of this approach occurs when each segment length approaches one-half wavelength. Therefore, the resonance is increased in frequency by a factor of N over the non-segmented approach. It is possible, using this approach, to obtain acceptable performance at any frequency by properly segmenting the loop.

FIG. 3 shows a synthesizer radiating system 30, as described in the '494 patent, employing a multi-segment loop radiator in the form of a single-turn loop separated into four segments 31–34. In FIG. 3, the single switching circuit of FIG. 2 is replaced by four switching circuits (i.e., for four "sub-circuits") 10*a*, 10*b*, 10*c*, 10*d*, each of which is coupled to the ends of two successive ones of loop segments 31–34, as shown. Each of the sub-circuits 10*a–d* may be similar to switching circuit 10 of FIG. 2, except for the described coupling to loop segments 31–34 instead of to the ends of continuous loop 12 as in FIG. 2. The multi-segment loop radiator system 30 thus comprises a loop antenna element configured as a plurality of successive loop segments 31–34 and a like plurality of switching circuits 10*a–d* each coupled to a different pair of loop segments. Each switching circuit (i.e., sub-circuit) includes switch devices arranged for controlled activation as described above to transfer energy back and forth from the loop segments to which it is coupled to a portion of said storage capacitance (i.e., to one of capacitors 14*a–d* of FIG. 3). Although any number of segments may be utilized pursuant to design considerations as discussed, in FIG. 3 the plurality of successive loop segments consists of four loop segments 31–34, which are employed with a like plurality of switching circuits consisting of four switching circuits 10*a–d*, each having a respective capacitor 14*a–d* coupled thereto. Thus, in FIG. 3, the basic storage capacitance comprises a plurality of capacitive devices, one coupled to each switching circuit. Operational and other aspects of the FIG. 3 system are described in greater detail in the '494 patent (in which FIG. 3 referred to above appears as FIG. 11).

With advances in wireless technology there is a steady progression toward the potential for implementation of a huge network in which human beings may effectively represent nodes in the network. There are many applications, especially in the area of military communications where the cellular model, with a central node through which all communications pass, is not most effective. Such non-cellular networks require the use of ground-to-ground communication. The propagation in ground-to-ground links is superior when the operating carrier frequency for the link is chosen in the lower regions of the frequency spectrum because of the relative immunity to blockage degradations that plague high frequency systems.

Although such propagation is superior at lower operating frequencies, operation at these frequencies has been typically avoided in the past because of the cumbersome antennas required for efficient coupling of transmit energy to radiation. Antennas are typically sized as an appreciable fraction of the wavelength at the operating frequency. At lower frequencies the wavelength may be in the 10 to 100 meter range, effectively limiting the portability of prior antennas.

Modern communication systems are typically wideband and frequency agile in order to suppress interference, and also to provide degrees of covertness or privacy. Thus, wideband antenna operation is desired. While in the past, it has been possible to reduce antenna size while maintaining efficiency over a very narrow band of frequencies, wideband efficiency has mandated the use of larger antennas.

A network of the type described may use each node in a semi-continuous manner, utilizing nodes not only for communication to and from that particular node but also as a relay for pass-through of data. As a result, a radio would not be utilized in a sporadic push-to-talk mode where it might be possible to temporarily erect and orient an antenna at appropriate times. It would also be desirable to provide a radiating system in a body-borne implementation that does not impede the host from performing other normal day-to-day activities. Further, if possible there should be no visual signature of the system that enables the antenna to be identified from afar. These two objectives are particularly important in military scenarios where a soldier will need to participate in normal combat operations while functioning as an active node in such a communication network. The combat operational environment also leads to the desirability that the system and antenna function equally well in any orientation, without degrading communication range. That contrasts to use of a typical wire stub antenna that must operate in a vertical orientation.

The electrical properties of the human body are far different from the open air that normally surrounds a radiating antenna. A body-borne antenna may typically be in close contact with human flesh. Because there are variations between different bodies, or even the same body from time to time, and there are variations that result from the presence of other equipment carried by that body, it is desirable that the antenna performance exhibit low sensitivity to such variations and characteristics. It would be undesirable to "retune" any antenna to the particular individual, or, in an extreme case, to require retuning for different clothing, how much perspiration is present, the presence of other equipment, or the position (standing, sitting, etc.) of a person using a body-borne antenna.

Objects of the invention are, therefore, to provide new and improved radiating systems, including crossed-loop and synthesizer radiating systems, providing one or more of the following advantages or characteristics:

- suitability for body-borne use;
- conformal to body;
- absence of protrusions from body creating visual signature;
- operability not dependent on body orientation;
- wide instantaneous bandwidth operation;
- high efficiency signal radiation;
- electrically small antenna elements;
- operability not limited by body effects or nearby objects; and
- absence of hazardous electromagnetic field effects.

SUMMARY OF THE INVENTION

In accordance with the invention, a crossed-loop radiation synthesizer system, wherein energy is transferred back and forth between each loop and storage capacitance via controlled activation of switch devices, includes a first loop antenna element configured as a plurality of successive loop segments and an offset loop antenna element configured as a plurality of successive loop segments and having an operating position offset in azimuth from the first loop antenna element. A first plurality of switch modules are each coupled to a different pair of loop segments of the first loop antenna element and a second plurality of switch modules are each coupled to a different pair of loop segments of the offset loop antenna element. Each switch module includes switch devices arranged for controlled activation to transfer energy back and forth between the storage capacitance and a loop antenna element. The radiating system may also include a coupler configuration to couple to the switch modules signals representative of signals to be transmitted, with signals coupled to the second plurality of switch modules having a phase offset (e.g., quadrature phase) relative to signals coupled to the first plurality of switch modules. The radiating system may further include an input/output unit (e.g., a radio) responsive to input information to provide signals representative of signals to be transmitted and also responsive to received signals to provide output signals representative of information contained in received signals. The radiating system as described may be combined with a wearable garment configured to support the loop antenna elements and switch modules, with the offset loop antenna element supported in an offset-in-azimuth operating position.

Radiation synthesizer systems may utilize optical modulators responsive to signals representative of signals to be transmitted and optical signal paths coupled between an optical modulator and switch modules. Operating power to the switch modules may be provided via antenna element loop segments which each include a plurality of parallel conductor portions arranged to enable coupling of a plurality of DC voltages to a switch module.

In a further embodiment, a crossed-loop radiation synthesizer system, wherein energy is transferred back and forth between each loop and storage capacitance via controlled activation of switch devices, may include a first loop antenna element and an offset loop antenna element having an operating position offset in azimuth from the first loop antenna element (e.g., in azimuth quadrature). The system includes at least one switch module coupled to the loop antenna elements, each switch module including switch devices arranged for controlled activation to transfer energy back and forth between the storage capacitance and a loop antenna element.

In an additional embodiment, a crossed-loop radiation system includes a first loop antenna element and an offset loop antenna element. A wearable garment is provided to support the loop antenna elements with the offset loop antenna element in an operating position offset in azimuth from the first loop antenna element. A coupler configuration is arranged to couple first signals to the first loop antenna element and second signals, comprising a phase offset replica of the first signals, to the offset loop antenna element.

For a better understanding of the invention, together with other and further objects, reference is made to the accompanying drawings and the scope of the invention will be pointed out in the accompanying claims.

DESCRIPTION OF THE INVENTION

Figure 4:
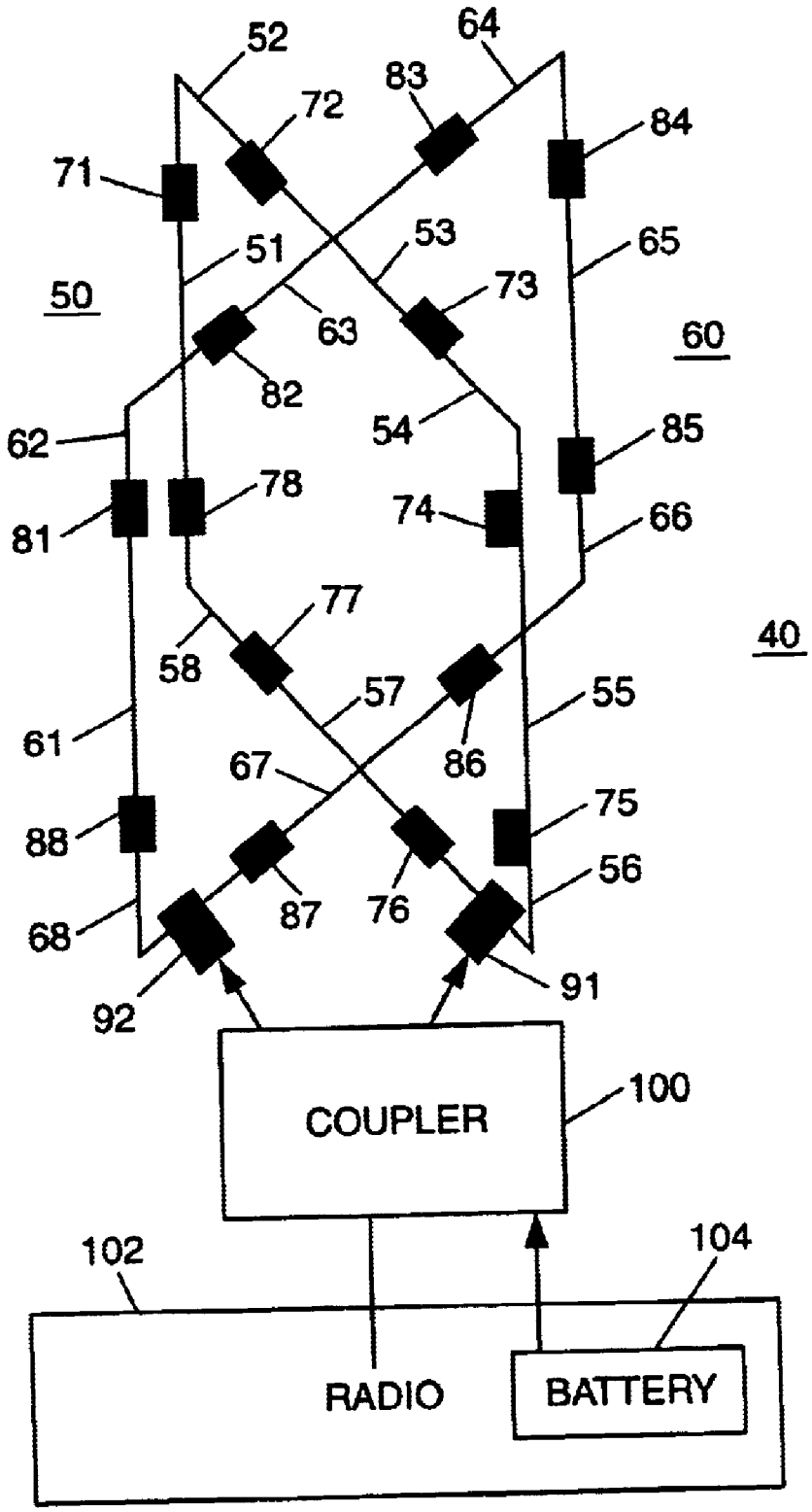
FIG. 4 is a simplified block diagram of a crossed-loop radiation system pursuant to the invention.

A simplified block diagram of a crossed-loop radiation synthesizer system 40 pursuant to the invention is illustrated in FIG. 4. As shown, the system is in the form of a distributed electronic circuit wherein energy is transferred back and forth between each loop (e.g., individual segments thereof) and storage capacitance (e.g., as apportioned to each loop segment) via controlled activation of switch devices (e.g., within switch modules shown between adjacent loop segments).

The FIG. 4 radiating system 40 includes a first loop antenna element 50 configured as a plurality of successive loop segments 51, 52, 53, 54, 55, 56, 57, 58. An offset loop antenna element 60 is configured as a plurality of loop segments 61, 62, 63, 64, 65, 66, 67, 68. As represented, offset loop antenna element 60 has an operating position offset in azimuth from the first loop antenna element 50. With the loop antenna elements 50 and 60 offset in this manner, this may be referred to as a crossed-loop radiating system. In this example, the azimuth offset is nominally 90 degrees, so that the loop antenna elements have a quadrature positional relationship. For present purposes, "nominally" is defined as indicating a relationship, angle, dimension, etc, which is within plus or minus twenty percent of a stated value or quantity.

Figure 1A:
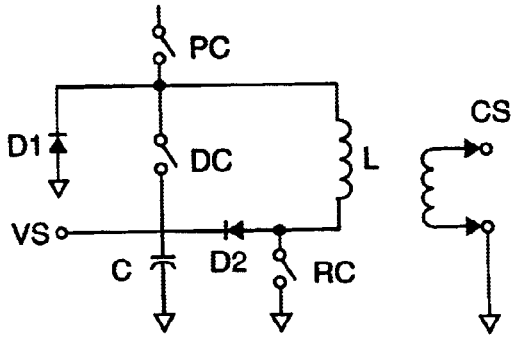
FIG. 1a PRIOR ART
FIGS. 1*b* and 1*c* are simplified circuit diagrams useful in describing operation of prior art synthesizer radiating systems.
Figure 1B:
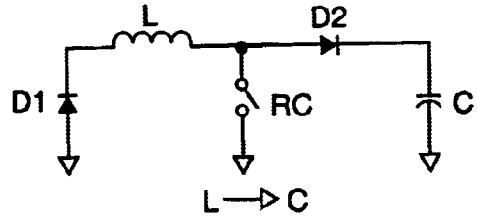
FIG. 1b PRIOR ART
Figure 1C:
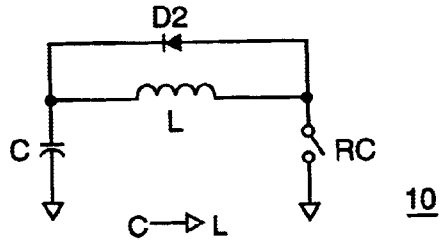
FIG. 1c PRIOR ART
Figure 2:
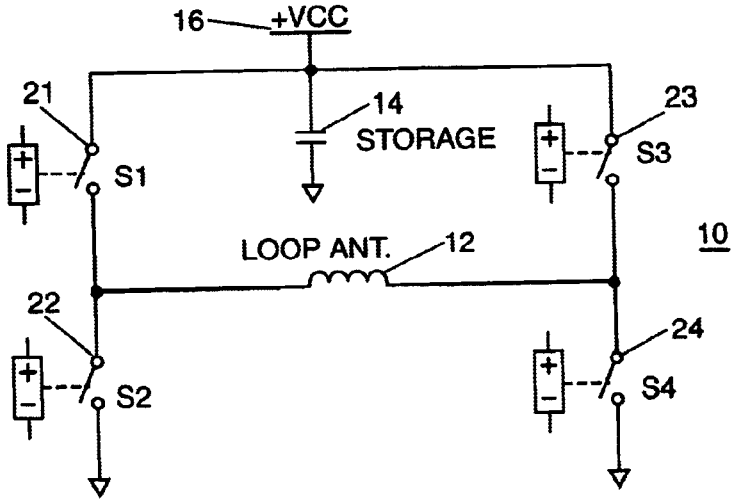
FIG. 2 PRIOR ART
FIG. 2 shows a form of prior art synthesizer radiating system.
Figure 3:
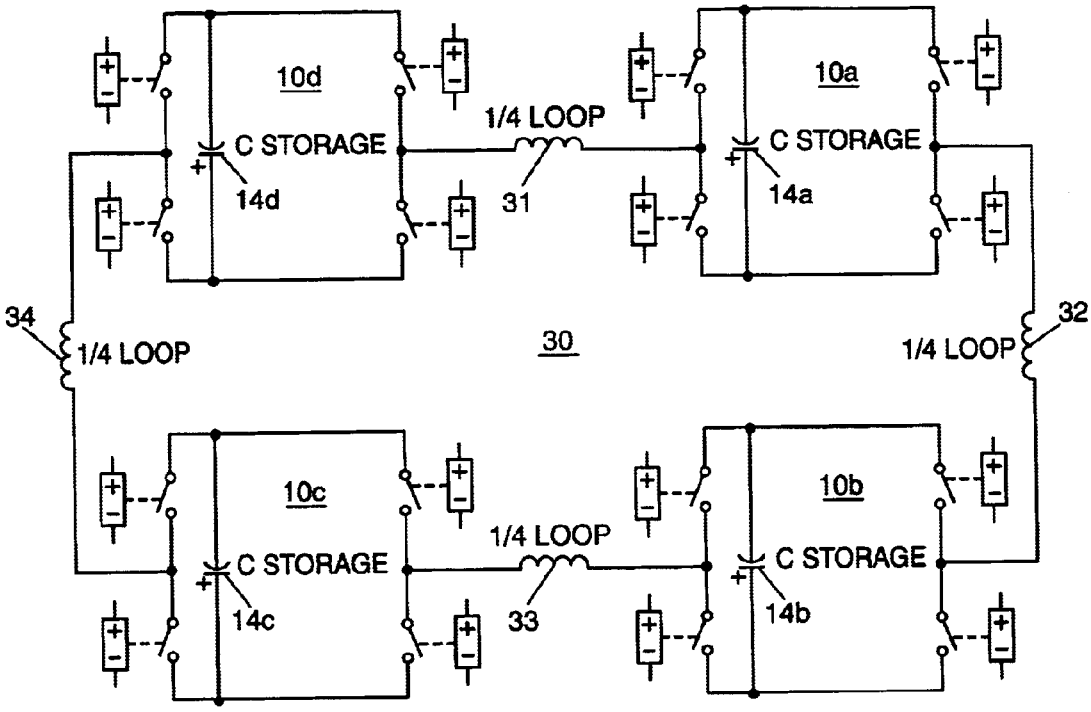
FIG. 3 PRIOR ART
FIG. 3 shows a prior art synthesizer radiating system employing a multi-segment loop radiator system.

The radiating system includes a first plurality of switch modules 71, 72, 73, 74, 75, 76, 77, 78 each coupled to a different pair of the loop segments 51–58 of the first loop antenna element. A second plurality of switch modules 81, 82, 83, 84, 85, 86, 87, 88 are each coupled to a different pair of the loop segments 61–68 of the offset loop antenna element. Thus, for example, switch module 81 is coupled to loop segments 61 and 62, switch module 82 to loop segments 62 and 63, etc. Each of the switch modules 71–78 and 81–88 includes switch devices arranged for controlled activation to transfer energy back and forth from a loop antenna element to storage capacitance. Reference is made to the switch devices included in switching circuits 10*a*–10*d* of FIG. 3, the associated storage capacitance portions 14*a*–14*d* and energy transfer action as described above and in the '494 patent. Optical fiber control signal feeds and multi-conductor loop segments for DC supply use will be described below.

The FIG. 4 radiating system 40 further includes a coupler configuration 100 to couple to the switch modules signals representative of signals to be transmitted. In this example, such signals are coupled to switch modules 71–78 via interface unit 91 and to switch modules 81–88 via interface unit 92. Coupler configuration 100 is arranged to provide to interface unit 92 (and thereby to switch modules 81–88) such signals having a phase offset relative to the signals coupled to interface unit 91 (and thereby to switch modules 71–78). In this example, the phase offset may be nominally 90 degrees in order to provide excitation of the loop antenna elements 50 and 60 in quadrature. Interface units 91 and 92 may include optical modulators to feed control signals to the switch modules via optical transmission paths, and DC supply circuitry to provide a plurality of DC supply voltages to the switch modules via multiple conductor loop segment configurations, as will be further described.

In the FIG. 4 example, the radiating system also includes radio 102, shown including a battery 104 or other suitable form of power supply. Radio 102 may be any suitable unit or equipment usable in the ordinary dictionary sense of "radio" as equipment usable for transmitting and receiving radio signals. In particular implementations, radio 102 may be arranged for transmission or reception, or both, and signals provided to coupler configuration may have the form of signals typically provided for radio transmission or may be modified or pre-processed in digital or other form suitable for usage by interface units 91 and 92, in the form of optical modulators, or otherwise. Appropriate signal formats may be provided by skilled persons in view of the present description.

Figure 5:
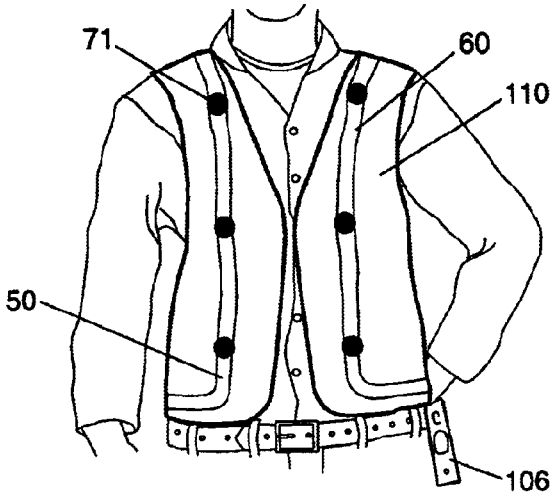
FIGS. 5 and 6 are respective front and rear representations of the FIG. 4 system as supported by a wearable garment worn by an individual.
Figure 6:
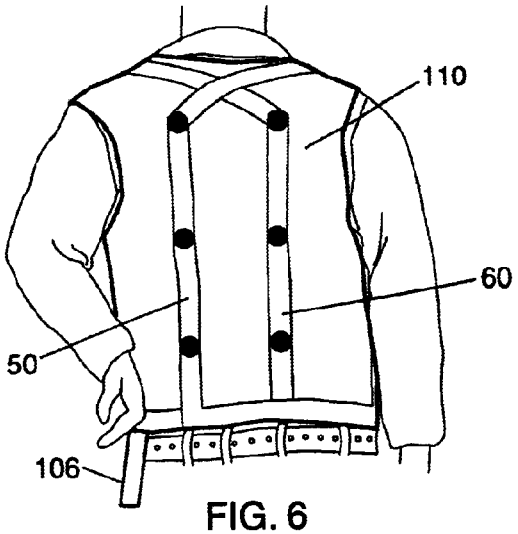

FIGS. 5 and 6 are respective front and rear representations of an individual wearing a wearable garment 110 configured to support loop antenna elements, such as loop elements 50 and 60 of FIG. 4. As illustrated, the offset loop antenna element 60 is in an offset-in-azimuth operating position as illustrated and described. Garment 110 may be in the nature of a vest, shirt, jacket, coat, or any suitable configuration and by way of example is represented as a vest. Garment 110 may be configured to provide warmth, general functionality, etc., may be configured as merely a shell to structurally support the loop antenna elements, or may have any other form and construction suitable for providing antenna element support for present purposes, in addition to any other functions provided. Loop antenna elements 50 and 60 may comprise flexible loop segments with miniaturized switch modules in a ribbon or other format and may be woven into, attached to, removably fastened to, or otherwise suitably arranged to be supported by garment 110 when worn by an individual.

In FIGS. 5 and 6 loop antenna elements 50 and 60 are illustrated as having a ribbon-like appearance and are positioned and supported in a relationship with vertical portions separated laterally in the front but overlapping in the FIG. 6 rear view. Thus, as shown, the rear vertical portion of loop element 50 is to the left of the rear vertical portion of loop element 60, with the rear horizontal portions of the loops overlapping as will be referred to further with reference to FIG. 7. In one presently preferred embodiment the loop antenna elements may be removably attached by velcro-type fastening strips. In FIGS. 5 and 6 the switch modules are represented for purposes of illustration as circles, such as circle 71, but may actually be incorporated into a ribbon-like structure of the loop antenna elements 50 and 60 and not be distinctly visible. As represented in FIGS. 5 and 6, radio 102 of FIG. 4 may comprise a belt mounted unit 106 carried by the individual wearer/user of the system. As appropriate in particular embodiments, system components, such as elements 91, 92, 102 104, may be supported by garment 110, included in unit 106, or otherwise made available for use via suitable interconnection. While described as providing radio functions, unit 106 may be arranged to enable information to be input and output via audible (speaker, earphone, etc.), visual (display, light emitting diodes, etc.), or other suitable forms of information transfer devices.

Figure 7:
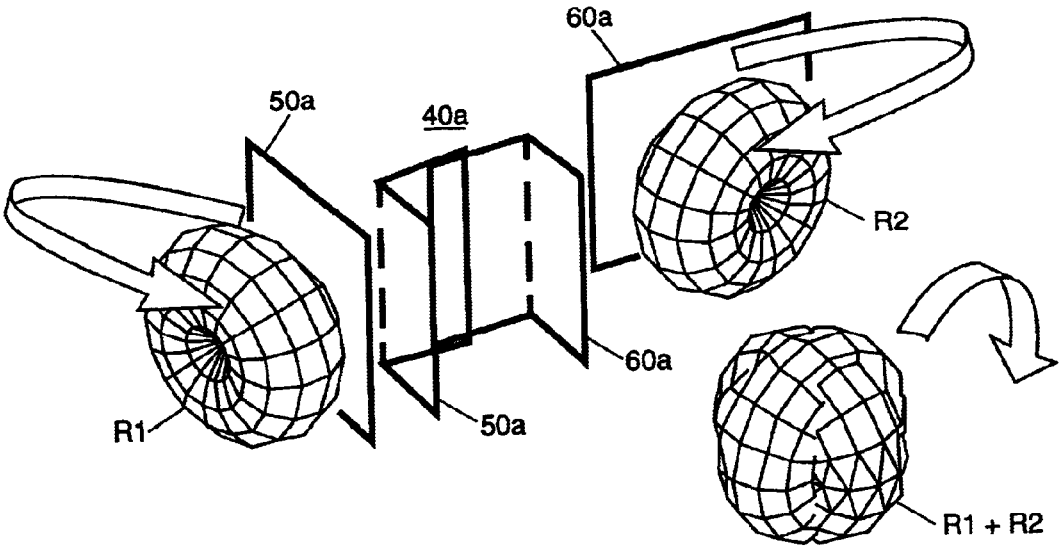
FIG. 7 illustrates radiation patterns useful in describing operation of the FIG. 4 system.

FIG. 7 illustrates, on a simplified basis, the radiation pattern R1 of simplified loop element 50*a* and the radiation pattern R2 of the crossed or offset loop element 60*a*. These well known patterns associated with loop radiators include omnidirectional coverage in one plane and a null orthogonal to that plane. For a body-borne radiating system it is desirable to approximate isotropic coverage, since the wearer's position (standing, prone, etc.) should not limit or prevent communication. The composite crossed-loop pattern provided by quadrature excitation of the loop elements, as discussed above, is represented as the R1+R2 pattern in FIG. 7. This combined pattern provides coverage closely approximating ideal isotropic coverage. If the garment mounted radiating system of FIGS. 5 and 6 is constructed to provide a composite pattern resembling pattern R1+R2 of FIG. 7, it will be appreciated that communication capability will be relatively unaffected by the wearer's position, whether standing, prone, etc. The offset loop diagram 40*a* at the center of FIG. 7 represents in a simplified manner the positioning of loop antenna elements 50 and 60 on garment 110 in FIGS. 5 and 6. While such positioning differs from the strictly quadrature positioning in FIG. 4, so that in use the composite pattern may differ from pattern R1+R2 of FIG. 7, a composite pattern can be provided which is sufficiently isotropic in nature as to enable effective communication regardless of the body position of the wearer. Implementations for particular applications can be specified, with modifications and adjustments as appropriate, by skilled persons.

Figure 8:
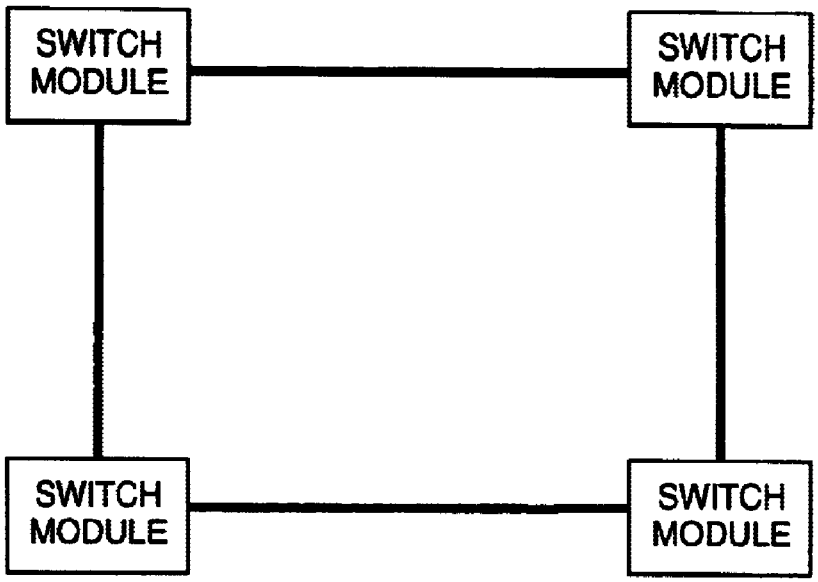
FIGS. 8, 9, 10 and 11 illustrate aspects of systems incorporating control signal feed via optical cables and DC voltage feed via multi-conductor antenna loop segments, as described in a copending application.
Figure 9:
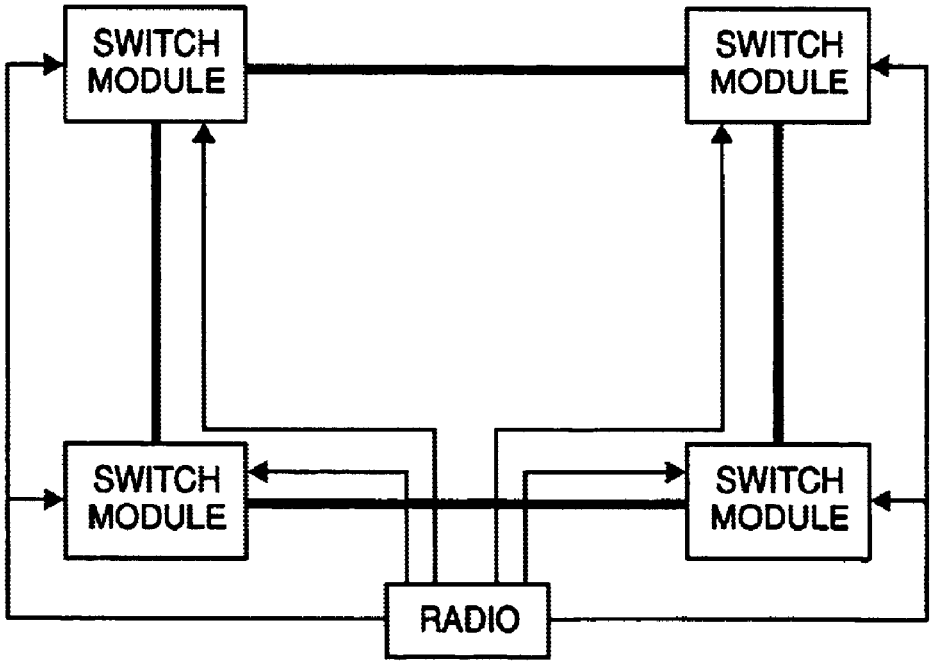
Figure 10:
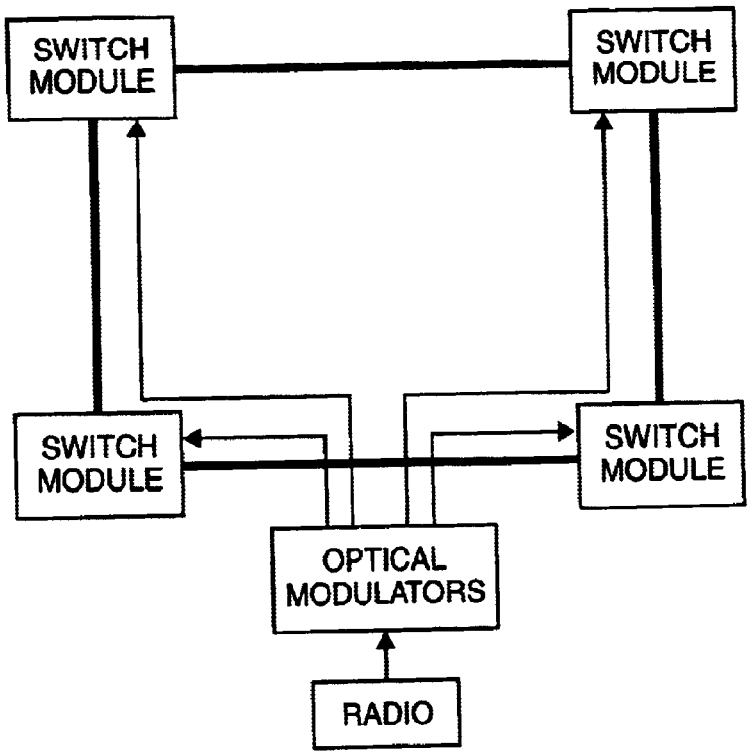
Figure 11:
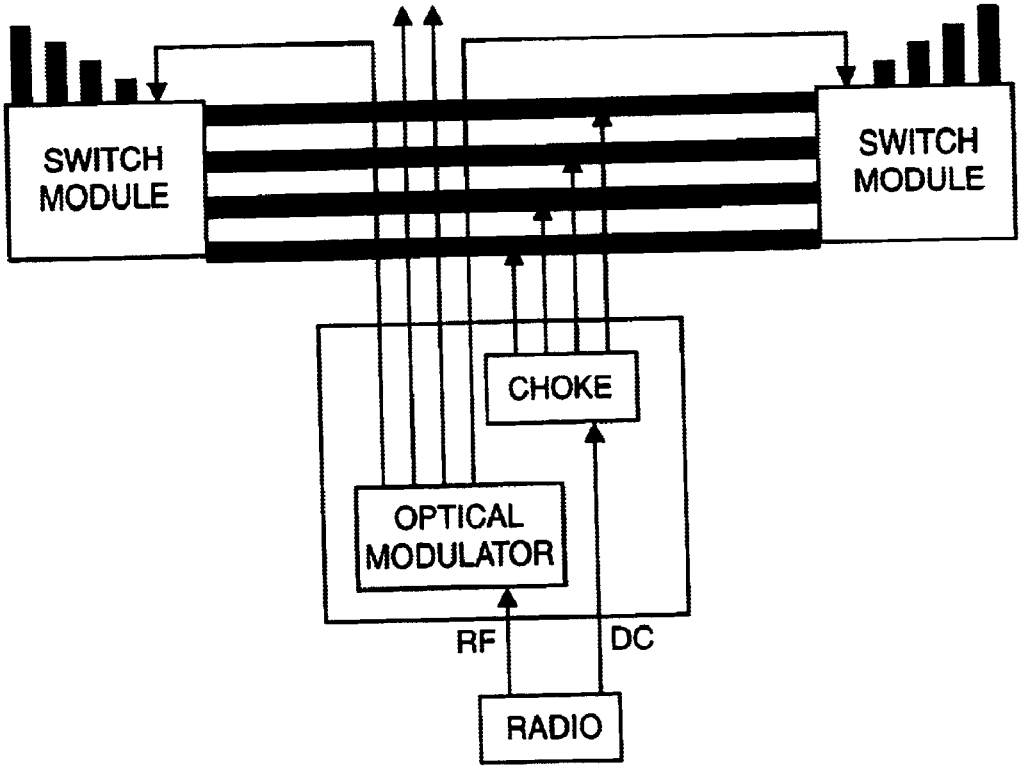

Aspects of implementation of crossed-loop synthesizer radiating systems will be briefly described with reference to FIGS. 8, 9, 10 and 11, which correspond respectively to FIGS. 4, 5, 7 and 8 of U.S. patent application Ser. No. 10/084,000, titled Radiation Synthesizer Feed Configurations, filed Feb. 26, 2002, and hereby incorporated by reference herein. FIG. 8 shows a basic loop antenna structure including successive loop segments and switch modules coupled therebetween. FIG. 9 shows a basic synthesizer radiating system, wherein identical individual switch control signals and common DC supply voltages are provided to the switch modules via interconnecting conductors. In FIG. 10 the conductors used to couple control signals in FIG. 9 are replaced by optical fiber cables fed by optical modulators responsive to signals from a radio. FIG. 11 is a partial representation of the synthesizer radiating system wherein a loop segment of the loop antenna element comprises parallel conductors fed in parallel for radiated signals, but DC isolated to provide supply conductors for a plurality of DC voltages powering the individual switch modules. This obviates the need to include separate DC supply conductors as included in FIG. 9. With optical feeds from the optical modulator, the switch modules will typically incorporate optical demodulators to provide electrical signals for control of switch devices within each switch module. Provision of fiber optic control signal feeds and diplexing of loop segments on an RF/DC basis to eliminate the need for separate DC supply conductors removes potential spurious paths for RF signals, enables a simpler, more flexible structure for garment mounting and flexibility, and provides other advantages structurally and operationally. More extensive description relating to FIGS. 8, 9, 10 and 11 is provided in the referenced co-pending application.

Figure 12:
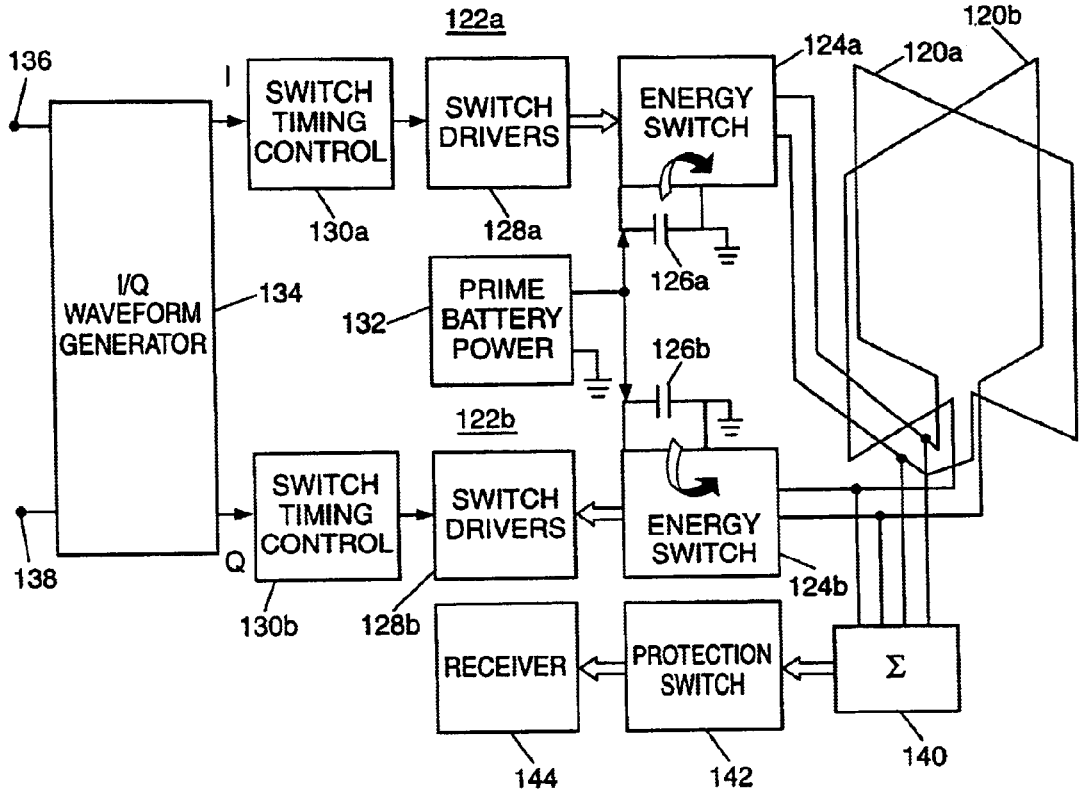
FIG. 12 is a simplified block diagram of an embodiment of the invention using non-segmented loop elements and arranged for transmit and receive.

Referring now to FIG. 12, there is shown a simplified block diagram of another embodiment of a crossed-loop radiating system in accordance with the invention. The FIG. 12 system includes crossed-loop antenna elements 120*a* and 120*b*, shown as simple loop elements which do not incorporate switch modules as in the description above. Loop elements 120*a* and 120*b* are arranged to be activated in quadrature phase by inclusion of two radiation synthesizer configurations 122*a* and 122*b* which may be implemented in accordance with the disclosures of the '133 and '494 patents. Thus, the synthesizer configuration 122*a* and 122*b* include respective energy switch units 124*a* and 124*b* to control energy transfer between the loop elements 120*a* and 120*b* and storage capacitors 126*a* and 126*b*, respectively, in response to control signals from switch drivers 128*a* and 128*b* under the timing control of respective switch timing control units 130*a* and 130*b*. Operating power is provided via common prime battery power unit 132. As noted, synthesizer configurations 122*a* and 122*b* may be implemented pursuant to the '133 and '494 patents.

The FIG. 12 system further includes an I/Q waveform generator 134 arranged to generate I and Q signals to respectively control operation of synthesizer configurations 122*a* and 122*b*, in response to baseband data information input via terminal 136 and carrier frequency command information input via terminal 138, to enable quadrature excitation and transmission via the antenna elements 120*a* and 120*b*. Also included in the FIG. 12 system, for signal reception, are summing unit 140 to combine quadrature phase signals received via the two loop antenna elements, protection switch unit 142 to limit coupling of transmission signals, and receiver unit 144 to provide information available from received signals in audio or other format.

The FIG. 12 system enables use of simple loop antenna elements without the added complexity and resulting benefits, advantages and capabilities made available by a FIG. 4 segmented-loop type system. The FIG. 12 type radiating system may be supported by a garment or otherwise employed. Other variations and arrangements, which may involve aspects of both types of systems, may be provided by skilled persons as appropriate in particular implementations.

Signal reception has been discussed with reference to FIG. 12, but not specifically with reference to systems such as illustrated in FIGS. 4, 5 and 6. Reference is made to provision of signal reception and receive/transmit capabilities and arrangements as described in U.S. patent application Ser. No. 10/114,102, titled Radiation Synthesizer Receive and Transmit Systems, filed concurrently herewith and hereby incorporated by reference herein. Skilled persons will be enabled to provide signal reception capabilities in radiating systems described herein, in view of the content of this co-pending application.

A crossed-loop radiation synthesizer for body-borne use may be designed for operation within a range of 5–100 MHZ with a pair of crossed-loop antenna elements measuring of the order of 0.5 meters on a side. As noted above, operation at such frequencies provides significantly reduced range degradation by buildings, foliage and other obstructions affecting ground-to-ground communication links, as compared to operation at higher frequencies. Also, the near electromagnetic fields of small loop antennas are primarily magnetic, so that the antenna may be considered to behave like a lumped inductor. Since dielectrics and relatively small metallic objects produce very little effect with respect to inductors, antenna and system performance are relatively independent of effects of contiguous human bodies (i.e., representing a lossy dielectric) or metallic objects (e.g., weapons) that would tend to detune or effectively short out electric field type radiators like a linear wire antenna (e.g., a monopole or dipole).

Simulations have established that a magnetic radiator performs of the order of 10 dB better than an electric radiator in the context of attempts to communicate from the outside to the inside of urban structures. Such structures are commonly constructed as a cage of steel beams covered with a variety of materials and including windows. This type of structure tends to short out the electric field, while enhancing the magnetic component. Crossed-loop antennas, as described, can thus provide significantly enhanced performance in many ground based applications which are subject to the presence of a variety of forms and types of obstructions.

It should be noted that antenna systems, particularly body-borne systems, when radiating should not present a biological danger to the user or wearer. Limitations on exposure to electromagnetic fields have been defined and established in guidelines published by the IEEE. Such guidelines clearly state the human body is more tolerant of magnetic fields than electric fields at low frequencies. Pursuant to such safety guidelines, crossed-loop radiation synthesizer systems for body-borne applications can both radiate more power than a linear wire antenna, and provide operation with adequate range for many applications, while adhering to field levels specified as safe by the guidelines.

While there have been described the currently preferred embodiments of the invention, those skilled in the art will recognize that other and further modifications may be made without departing from the invention and it is intended to claim all modifications and variations as fall within the scope of the invention.

What is claimed is:

1. A crossed-loop radiation synthesizer system, wherein energy is transferred back and forth between each loop and storage capacitance via controlled activation of switch devices, comprising:

a first loop antenna element configured as a plurality of successive loop segments;

an offset loop antenna element configured as a plurality of successive loop segments and having an operating position offset in azimuth from the first loop antenna element;

storage capacitance;

a first plurality of switch modules each coupled to a different pair of loop segments of the first loop antenna element; and a second plurality of switch modules each coupled to a different pair of loop segments of the offset loop antenna element;

each switch module including switch devices arranged for controlled activation to transfer energy back and forth between the storage capacitance and a loop antenna element.

2. A crossed-loop radiation synthesizer system as in claim 1, further comprising:

a coupler configuration to couple to the switch modules signals representative of signals to be transmitted, with signals coupled to said second plurality of switch modules having a phase offset relative to signals coupled to said first plurality of switch modules.

3. A crossed-loop radiation synthesizer system as in claim 2, wherein said signals coupled to the second plurality of switch modules have a nominally quadrature phase relationship to said signals coupled to the first plurality of switch modules.

4. A crossed-loop radiation synthesizer system as in claim 2, further comprising:

an input/output unit coupled to said coupler configuration, the input/output unit responsive to input information to provide signals representative of signals to be transmitted and responsive to received signals from said coupler configuration to provide output signals representative of information contained in the received signals.

5. A crossed-loop radiation synthesizer as in claim 2, further comprising:

a radio coupled to the switch modules, the radio responsive to input information to provide signals representative of signals to be transmitted and responsive to received signals from said coupler configuration to provide output signals representative of information contained in the received signals.

6. A crossed-loop radiation synthesizer system as in claim 1, further comprising:

a wearable garment configured to support said loop antenna elements and switch modules with the offset loop antenna element in said operating position offset in azimuth.

7. A crossed-loop radiation synthesizer system as in claim 6, wherein said loop segments comprise flexible conductors and said garment is one of a vest, a shirt, a jacket and a coat.

8. A crossed-loop radiation synthesizer system as in claim 1, further comprising:

at least one optical modulator responsive to signals representative of signals to be transmitted; and at least one optical signal path coupled between the optical modulator and at least one of said switch modules.

9. A crossed-loop radiation synthesizer system as in claim 1, further comprising:

a coupler configuration to couple first transmit signals representative of signals to be transmitted and second transmit signals comprising a phase offset replica of said first transmit signals;

a first optical modulator responsive to said first transmit signals;

a plurality of optical signal paths coupling the first optical modulator to each switch module of said first plurality thereof;

a second optical modulator responsive to said second transmit signals; and a plurality of optical signal paths coupling the second optical modulator to each switch module of said second plurality thereof.

10. A crossed-loop radiation synthesizer system as in claim 9, wherein each said switch module includes an optical demodulator.

11. A crossed-loop radiation synthesizer system as in claim 1, wherein each said loop segment comprises a plurality of parallel conductor portions arranged to enable coupling of at least one DC voltage to a said switch module.

12. A crossed-loop radiation synthesizer system, wherein energy is transferred back and forth between each loop and storage capacitance via controlled activation of switch devices, comprising:

a first loop antenna element;

an offset loop antenna element having an operating position offset in azimuth from the first loop antenna element;

storage capacitance;

at least one switch module coupled to a said loop antenna element, each switch module including switch devices arranged for controlled activation to transfer energy back and forth between the storage capacitance and a loop antenna element; and a DC supply coupled to the at least one switch module to supply energy for radiation of signals via both of the first and offset loop antenna elements.

13. A crossed-loop radiation synthesizer system as in claim 12, including at least first and second switch modules coupled respectively to the first and offset loop antenna elements, and further comprising:

a coupler configuration to couple to the switch modules signals representative of signals to be transmitted, signals coupled to said second switch module having a phase offset relative to signals coupled to said first switch module.

14. A crossed-loop radiation synthesizer system as in claim 13, further comprising:

an input/output unit coupled to said coupler configuration, the input/output unit responsive to input information to provide signals representative of signals to be transmitted and responsive to received signals from said coupler configuration to provide output signals representative of information contained in the received signals.

15. A crossed-loop radiation synthesizer system as in claim 12, further comprising:

a wearable garment configured to support said loop antenna elements and said at least one switch module with the offset loop antenna element in said operating position offset in azimuth.

16. A crossed-loop radiation synthesizer system, wherein energy is transferred back and forth between each loop and storage capacitance via controlled activation of switch devices, comprising:

a first loop antenna element;

an offset loop antenna element having an operating position offset in azimuth from the first loop antenna element;

storage capacitance;

at least one switch module coupled to a said loop antenna element, each switch module including switch devices arranged for controlled activation to transfer energy back and forth between the storage capacitance and a loop antenna element;

a coupler configuration to couple to the switch modules signals representative of signals to be transmitted, signals coupled to said second switch module having a phase offset relative to signals coupled to said first switch module; and a radio coupled to the switch modules, the radio responsive to input information to provide signals representative of signals to be transmitted and responsive to received signals from said coupler configuration to provide output signals representative of information contained in the received signals.

17. A crossed-loop radiation system, comprising:

a first loop antenna element;

an offset loop antenna element;

a wearable garment configured to support the loop antenna elements with the offset loop antenna element in an operating position offset in azimuth from the first loop antenna element;

a coupler configuration to couple first signals to the first loop antenna element and second signals, comprising a phase offset replica of said first signals, to the offset loop antenna element; and a radio unit coupled to the coupler configuration to enable communication by at least one of transmission and reception of radio signals via the first and offset loop antenna elements.

18. A crossed-loop radiation system as in claim 17, wherein said loop antenna elements comprise flexible conductors.

19. A crossed-loop radiation system as in claim 18, wherein said wearable garment is one of a vest, a shirt, a jacket and a coat.

20. A crossed-loop radiation system as in claim 17, wherein the coupler configuration is arranged to couple said second signals with a nominally quadrature phase relationship to said first signals.

* * * * *